US008226782B2

(12) United States Patent
Kneisl

(10) Patent No.: US 8,226,782 B2
(45) Date of Patent: Jul. 24, 2012

(54) APPLICATION OF HIGH TEMPERATURE EXPLOSIVE TO DOWNHOLE USE

(75) Inventor: Philip Kneisl, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 997 days.

(21) Appl. No.: 12/171,162

(22) Filed: Jul. 10, 2008

(65) Prior Publication Data

US 2010/0006193 A1 Jan. 14, 2010

(51) Int. Cl.

| | |
|---|---|
| ***C06B 25/00*** | (2006.01) |
| ***C06B 25/34*** | (2006.01) |
| ***C06B 25/04*** | (2006.01) |
| ***D03D 23/00*** | (2006.01) |
| ***D03D 43/00*** | (2006.01) |

(52) U.S. Cl. ..... 149/92; 149/88; 149/105; 149/108.8; 149/109.4

(58) Field of Classification Search ..... 149/92, 149/88, 105, 108.8, 109.4
See application file for complete search history.

(56) References Cited

U.S. PATENT DOCUMENTS

| | | | | |
|---|---|---|---|---|
| 2,435,645 | A * | 2/1948 | Bergstrom | 417/353 |
| 6,989,064 | B2 * | 1/2006 | Kneisl | 149/19.3 |
| 2002/0129940 | A1 * | 9/2002 | Yang et al. | 166/299 |
| 2004/0050466 | A1 * | 3/2004 | Kneisl | 149/19.3 |
| 2006/0272756 | A1 * | 12/2006 | Kneisl et al. | 149/92 |

FOREIGN PATENT DOCUMENTS

| | | | |
|---|---|---|---|
| GB | 2426974 | A | 12/2006 |
| GB | 2435645 | A | 9/2007 |

OTHER PUBLICATIONS

Agrawal et al. Organic Chemistry of Explosives. Chichester, England: John Wiley & Sons, 1-20 Ltd, 2007, ISBN 0-470-02967-6, especially p. 128.

Lotsch 'From Molecular Building Blocks to Condensed Carbon Nitride Networks: Structure 8-10 and 18-20 and Reactivity' Dec. 19, 2006 retrieved from the Internet <hltp://edoc.ub.unimuenchen.de/6492/1/Lotsch_Betlina_V. pdf>.

* cited by examiner

*Primary Examiner* — James McDonough
(74) *Attorney, Agent, or Firm* — Chadwick A. Sullivan; Rodney Warfford

(57) ABSTRACT

A downhole device having an explosive component includes a high temperature stable explosive having thermal stability greater than 200° C., wherein the explosives having a compound of formula (I) or (II):

(I)

(II)

6 Claims, 5 Drawing Sheets

APPLICATION OF HIGH TEMPERATURE EXPLOSIVE TO DOWNHOLE USE

BACKGROUND OF INVENTION

1. Field of the Invention

The present invention relates generally to the fields of oilfield exploration, production, and testing, and more specifically to the methods and apparatus for perforation and fracturing formations using high temperature stable explosives.

2. Background

Explosives are used in numerous downhole applications. An essential consideration in selecting explosives for use in downhole applications, such as perforating operations, is that the explosives should have a certain range of time and temperature, in which the explosives are thermally stable. That is, a given explosive will be stable at a temperature for a certain duration without appreciable decomposition or loss of performance. Typically, the higher the temperature, the shorter the duration will be, and vice versa. If the explosives are subjected to conditions beyond their stable temperature-time ranges, the explosives may start to decompose, burn, or autodetonate. Decomposition of the explosives generally reduces their effectiveness and may cause a failure, such as a misfire (a failure to detonate).

Failures of explosives could be costly and dangerous. For example, in perforating applications, when a perforating gun string is lowered to a desired depth but for some reason cannot be activated, a mis-run has occurred. The mis-run requires that the perforating gun string be pulled out of the wellbore and replaced with a new gun string. Such replacement is both time consuming and expensive. Furthermore, retrieving a mis-fired gun from a wellbore can be dangerous.

Due to the time-temperature range considerations, use of explosive devices in downhole applications may be impractical or impossible in some situations. In many operations, where explosive actuation was desired (i.e., a device using a frangible member), alternative actuating means were selected because it may be dangerous to use the explosives in the high temperature environment. In order to use explosive devices in downhole operations, it is desirable that the temperature-time ranges of the explosives be increased, i.e., the operating time for the explosives be increased for a given temperature.

U.S. Patent Application Publication No. 2002/0129940 discloses several explosive compositions adapted for use in downhole applications where high temperature explosives are required. These high temperature explosives may be exposed to elevated temperatures for extended periods of time. Examples of these explosives include nonanitroterphenyl (NONA), octanitroterphenyl (ONT), pentanitrobenzophenone (PENCO), tetranitronaphthalene (TNN), tripicryltriazine (TPT), tetranitrobenzotriazolo [1,2-a] benzotriazole (T-Tacot), picrylaminotriazole (PATO), dinitropicrylbenzotriazole (BTX), dodecanitroquaterphenyl (DODECA), tripicrylmelamine (TPM), axobishexanitrobiphenyl (ABH), tetranitrobenzotriazolo[2,1-a]benzotriazole (Z-Tacot), potassium salt of hexanitrodiphenylamine (KHND), tripicrylbenzene (TPB), dipicramide (DIPAM), hexanitroazobenzene (HNAB), bis-hexanitroazobenzene (bis-HNAB), hexanitrobiphenyl (HNBP), dipicrylbenzobiatriazoledione (DPBT), dipicrylpyromellitude (DPPM), hexanitrodiphenylsulfone (HNDS), and bis[picrylazo]dinitropyridine (PADP-I), sodium tetranitrocarbozole (NaTNC), hexanitrobibenzyl (HNBIB), tetranitro carbazole (TNC), 3,6 diamino 1,2,4,5 tetrazene (DAT), 2,6-diamino-3,5-dinitropyridino-1-oxide (DADNPO), octanitromacro cycle (ONM), 4,6 dinitrobenzofuroxan (ADNBF), 2,5-dipcryl -1,3,4-oxadiazole (DPO) and m-picrylpicramide (PIPA).

Though these high temperature stable explosives are useful for downhole applications, such as in perforating applications, tubing and casing cutters, explosive-actuated sleeves, sonic or seismic fracing devices, explosively setting devices, explosively opening production valves, explosive actuated sliding sleeves (valves or shuttles), breakable or frangible elements, tubing release devices, actuating devices, and propellant assemblies. There is still a need for explosives with improved thermal stability for downhole use.

SUMMARY OF INVENTION

One aspect of the invention relates to a downhole device. A downhole device in accordance with one embodiment of the invention includes a high temperature stable explosive having thermal stability greater than 200° C., wherein the high temperature stable explosives having a compound of formula (I):

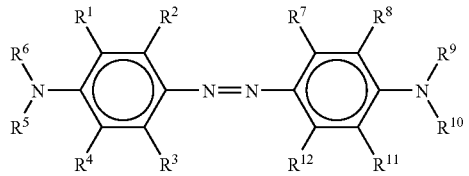

Wherein $R^1$, $R^2$, $R^3$, $R^4$, $R^7$, $R^8$, $R^{11}$, and $R^{12}$ are each independently hydrogen or —$NO_2$; $R^5$, $R^6$, $R^9$, and $R^{10}$ are each independently hydrogen, oxygen, or

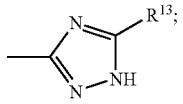

and $R^{13}$ is independently selected from hydrogen and —$NO_2$.

A downhole device in accordance with one embodiment of the invention includes a high temperature stable explosive having thermal stability greater than 200° C., wherein

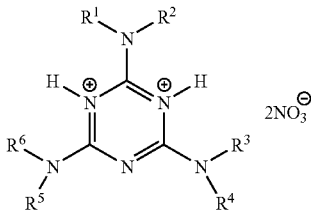

the high temperature stable explosives having a compound of formula (II):

wherein $R^1$, $R^2$, $R^3$, $R^4$, $R^5$, and $R^6$ are independently selected from hydrogen or oxygen.

Another aspect of the invention relates to methods of using one or more high temperature stable explosives in a downhole operation. A method (II) in accordance with one embodiment of the invention includes lowering into a wellbore a downhole device having a high temperature stable explosive with a thermal stability greater than 200° C., and igniting the high temperature stable explosive to perform the downhole operation, wherein the high temperature stable explosives having a compound of formula (I) or (II) as shown above.

Other aspects and advantages of the invention will be apparent from the following description and the appended claims.

DETAILED DESCRIPTION

Figure 1:
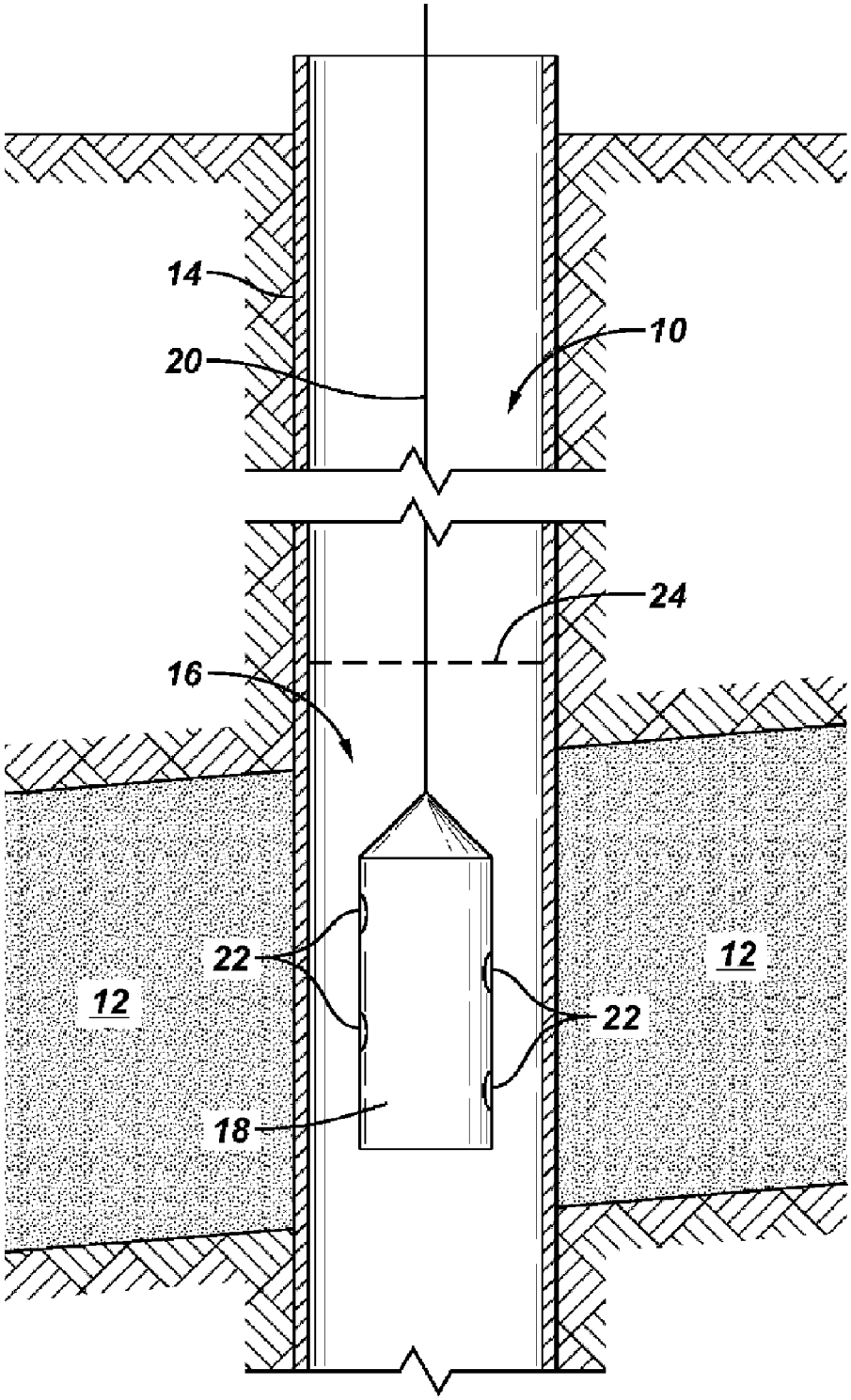
FIG. 1 shows a schematic diagram of a perforating system in accordance with one embodiment of the present invention, prior to detonation of the perforating charges.

Embodiments of the invention relate to methods and apparatus for perforation and fracturing formations using high temperature stable explosives. In the following detailed description of the subject matter of the present invention, high temperature stable explosives are principally described as being used in oil well applications. Such applications are intended for illustration purposes only and are not intended to limit the scope of the present invention. For example, the high temperature stable explosives of the present invention may be used for any conceivable downhole device/application for which explosives are suitable. More specifically, the high temperature stable explosives are particularly suited for applications requiring high performance capability (i.e., jet production) combined with thermal stability at high temperature and/or exposures at elevated temperatures for extended periods of time. The high temperature stable explosives may also be used in operations within gas wells, water wells, injection wells, and control wells. All such applications are intended to fall within the purview of the present invention. However, for purposes of illustration, the high temperature stable explosives will be described as being used for oil well applications.

"High temperature stable explosives" as used herein refer to explosives that are characterized by minimal decomposition (which may be estimated by gas loss) caused by exposure to elevated temperatures for extended periods of time. Thermal stability of such an explosive may be tested in a laboratory using an oven set at a selected temperature. The explosive is placed in the oven and at certain time points a portion of the explosive may be analyzed for any decomposition (usually by volume of evolved gas or weight loss). For use in downhole applications, suitable "high temperature stable explosives" are those that are stable at the downhole temperatures (typically, 200° C. or higher) for a duration of the intended operations, e.g., several hours. The temperature/time suitability or performance ratings of the identified high temperature downhole explosives provide a substantial benefit in the ability of tools and equipment to perform well at elevated temperatures for extended periods of time.

In accordance with embodiments of the invention, high temperature stable explosives, for example, may include compounds having the formula (I):

(I)

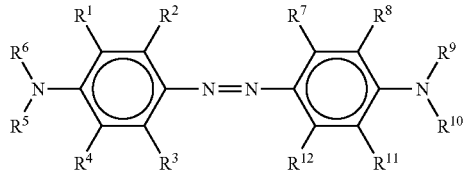

Wherein: $R^1$, $R^2$, $R^3$, $R^4$, $R^7$, $R^8$, $R^{11}$, and $R^{12}$ are each independently hydrogen or —$NO_2$; $R^5$, $R^6$, $R^9$, and $R^{10}$ are each independently hydrogen, oxygen, or

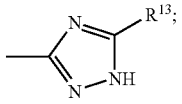

and $R^{13}$ is independently selected from hydrogen or —$NO_2$.

One example of a compound having formula (I) is N,N'-bis(1,2,4-triazol-3-yl)-4,4'-diamino-2,2',3,3',5,5',6,6'-octanitroazobenzene (BTDAONAB). The chemical structure of BTDAONAB is shown below:

17

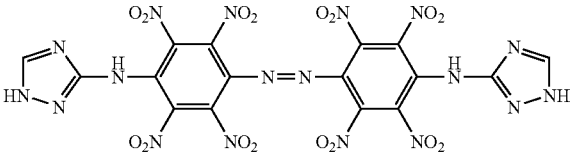

N,N'-bis(1,2,4-triazol-3-yl)-4,4'-diamino-2,2',3,3',5,5',6,6'-octanitroazobenzene (BTDAONAB)

The synthesis of BTDAONAB has been reported by Sikder et al. (*Indian J. Engineering & Materials Sci.* 11:516-520, 2004) and Agrawal et al. (Organic Chemistry of Explosives, John Wiley & Sons, 2007, ISBN-13 978-0-470-029667-1 (HB)). Briefly, BTDAONAB may be synthesized by tandem nitration-oxidative coupling of 4-chloro-3,5-dinitroaniline, followed by displacement of the chloro groups with 3-amino-1,2,4-triazole.

It has been found that BTDAONAB has a detonation velocity of about 8.321 km/sec and a first DSC (Differential Scanning Calorimetry) exotherm about 550° C., which is significantly higher than those of NONA, ONT, TACOT, and PYX. In particular, BTDAONAB has an exceptional thermal stability about 80° C. (with an one-hour testing duration) higher than that of NONA or ONT, which are currently the most stable explosives known for oilfield use. Thermal stability of an explosive concerns two aspects. First, there should be enough explosive left after it has partially decomposed so that the remaining portion is still useful, i.e. has enough energy to do useful work. Second, the explosive remaining after decomposition should be sensitive enough to be initiated or detonated. Thermal stability of an explosive may be specified in time (duration), within which they are stable, at a defined temperature. More commonly, thermal stability of an explosive is defined as a temperature limit at which it is stable for a selected duration (e.g., 1 hour, 100 hours, or any specific duration). As used herein, "thermal stability" or "thermally stable" refers to a temperature limit that an explosive is stable for 1 hour.

In accordance with some embodiments of the invention, high temperature stable explosives may include a compound having formula (II):

(II)

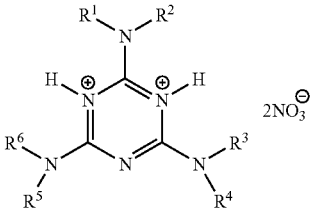

Wherein $R^1$, $R^2$, $R^3$, $R^4$, $R^5$, and $R^6$ are independently selected from hydrogen or oxygen.

One examples of a compound having formula (II) is melaminium dinitrate (MDN). The chemical structure of MDN is shown below:

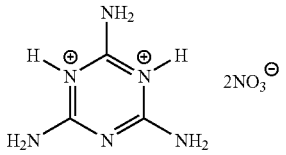

MDN is a thermally stable salt of melamine (2,4,6-triamino-1,3,5-triazine) and nitric acid. The synthesis of MDN has been reported by Friedemann et al. (*New Trends Res. Energetic Materials*. Part II, Pardubice, Czech Republic, 876-882, Apr. 25-27, 2007). Briefly, MDN may be prepared by slowly mixing warm nitric acid with melamine solution (100° C.). After cooling to room temperature, MDN crystals may be precipitated and obtained by filtration. Using the method of Rothstein and Peterson (*Propellants, Explosives, and Pyrotechnics,* 4:56, 1979), the detonation velocity of MDN is estimated to be 8.91 km/sec. The thermal stability for MDN may be tested using an oven at a set temperature for a period of time. For example, MDN was found to be stable at 137 ° C. for 48 hours without detectable decomposition. Therefore, MDN should be stable at a temperature about 200 ° C. (the temperature found in wellbore) for several hours, making it suitable for use in wellbore applications.

As an explosive, MDN appears to exhibit properties (such as densities, detonation velocities, and thermal stability) similar to other explosives, including RDX and HMX. However, the advantages of using MDN include the ease and the low cost of manufacturing MDN, as compared with that of RDX or HMX. Therefore, MDN or its analogues may be low cost alternatives to RDX or HMX with good performance and good oxygen balance.

The following examples are illustrative of the downhole applications for which the high temperature stable explosives of the present invention may be advantageously used. These examples are intended for illustration purposes only and are not intended to limit the scope of the present invention. In fact, high temperature stable explosives of the present invention may be advantageously used in any downhole applications that require high temperature stable explosives, such as oilfield perforators, boosters, primers, detonating cord, detonators, propellants, and pyrotechnic mixtures. All such applications are intended to fall within the purview of the present invention.

Figure 2:
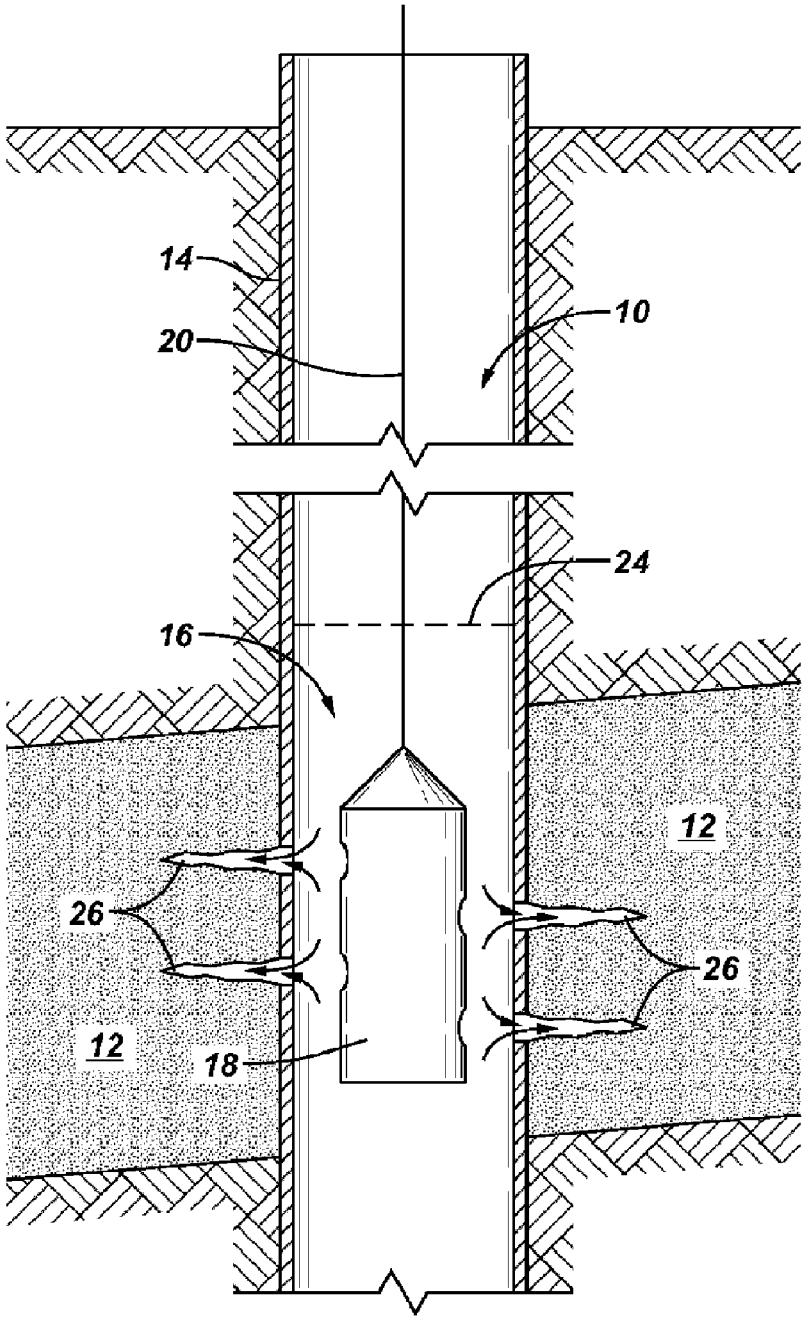
FIG. 2 shows a schematic diagram of a perforating system in accordance with one embodiment of the present invention, after detonation of the perforating charges.

FIG. 1 shows a schematic of a perforating system in which the above-described high temperature stable explosives may be used. A borehole 10 has been drilled from the surface down through subterranean formations 12 that contain hydrocarbon formation fluids, namely oil and/or gas. A generally cylindrical casing 14 lines the wall of the borehole, defining the wellbore 16. A perforating gun 18 has been lowered into the well on a tool string 20, e.g., wireline. The perforating gun includes at least one, and usually several explosive perforating charges 22 that contain high temperature stable explosives of the present invention. These charges may be oriented such that when they are detonated, the force of the explosion will be primarily directed outward toward the casing (i.e., horizontally outward in FIG. 1). Detonation may be triggered by a signal delivered through a detonating cord from the surface and boosters (or primers) in these charges (not shown in the figures). When the high temperature stable explosives are detonated, perforations 26 are formed in the casing 14 and into the formation 12, as shown in FIG. 2.

Figure 3:
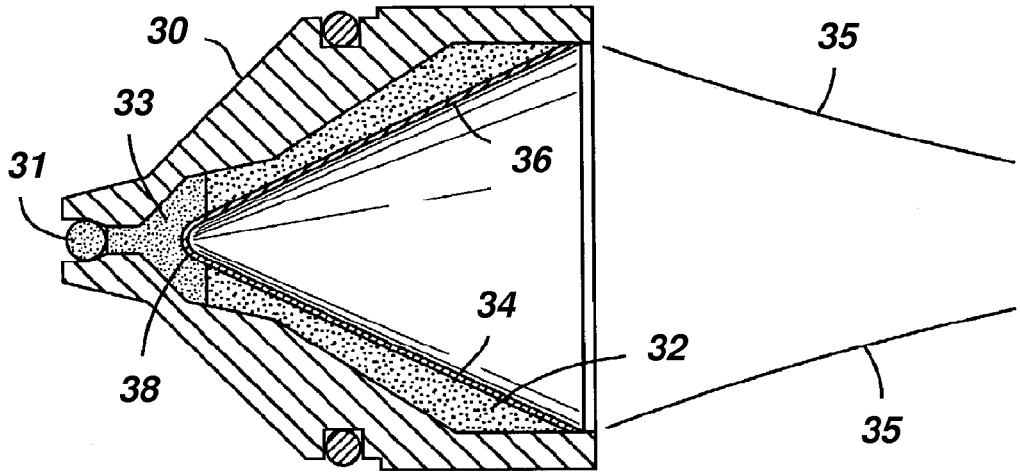
FIG. 3 shows a perforating shaped charge in accordance with one embodiment of the present invention.

FIG. 3 shows a typical shaped charge adapted for use in a perforating gun (not shown in the figure). Examples of shaped charges are discussed in U.S. Pat. No. 4,724,767 to Aseltine issued Feb. 16, 1988; U.S. Pat. No. 5,413,048 to Werner et al. issued May 9, 1995; and in U.S. Pat. No. 5,597,974 to Voreck, Jr. et al. issued Jan. 28, 1997.

In FIG. 3, the shaped charge includes a case 30, a main body of explosive material 32, which in the past has been, for example, RDX, HMX, PYX, or HNS packed against the inner wall of the case 30, a booster (or primer) 33 disposed adjacent the main body of explosive 32 that is adapted to detonate the main body of explosive 32 when the booster 33 is detonated, and a liner 34 lining the booster 33 and the main body of explosive material 32. The shaped charge also includes an apex 38 and a skirt 36. A detonating cord 31 contacts the case 30 of the shaped charge at a point near the apex 38 of the liner 34 of the charge. When a detonation wave propagates within the detonating cord 31, the detonation wave will detonate the booster 33. When the booster 33 is detonated, the detonation will further detonate the main body of explosive 32 of the charge. In response to the detonation of the main body of explosive 32, the liner 34 will form a jet 35 that will propagate along a longitudinal axis of the shaped charge. The jet 35 will perforate a formation penetrated by the wellbore.

In accordance with embodiments of the present invention, the detonating cord 31, the main body of explosive 32, and the booster (or primer) 33 may include one or more high temperature stable explosives of the invention, such as explosives having chemical structure of formula (I), e.g., BTDAONAB, or formula (II), e.g., MDN. In addition, they may also include one or more other high temperature explosives, such as NONA, PATO, BTX, DIPAM, PENCO, TNN, HNAB, TPM, ABH, bis-HNAB, DODECA, HNBP, Z-Tacot, T-Tacot, DPBT, DPPM, HNDS, KHND, ONT, TPB, TPT, PADP-I, NaTNC, HNBIB, TNC, DAT, DADNPO, ONM, ADNBF, DPO, and PIPA. Furthermore, they may include mixtures of one or more high temperature stable explosives and one or more other explosive compounds, such as HNS, PYX, HMX, or one or more high temperature stable explosives combined/mixed with one or more of an energetic material and/or a fuel. As a result, the shaped charge may exhibit exceptional thermal stability characteristics.

The high temperature stable explosives used in a shaped charge may be adapted for use in, for example, a tubing or casing cutter, a tubing release mechanism, a sonic fracing mechanism, an explosively set downhole apparatus, an apparatus for explosively opening a production valve, and an apparatus for actuating downhole tools by firing an explosive charge to generate an operating pressure, as disclosed in U.S. Application Publication No. 2002/0129940.

Figure 4:
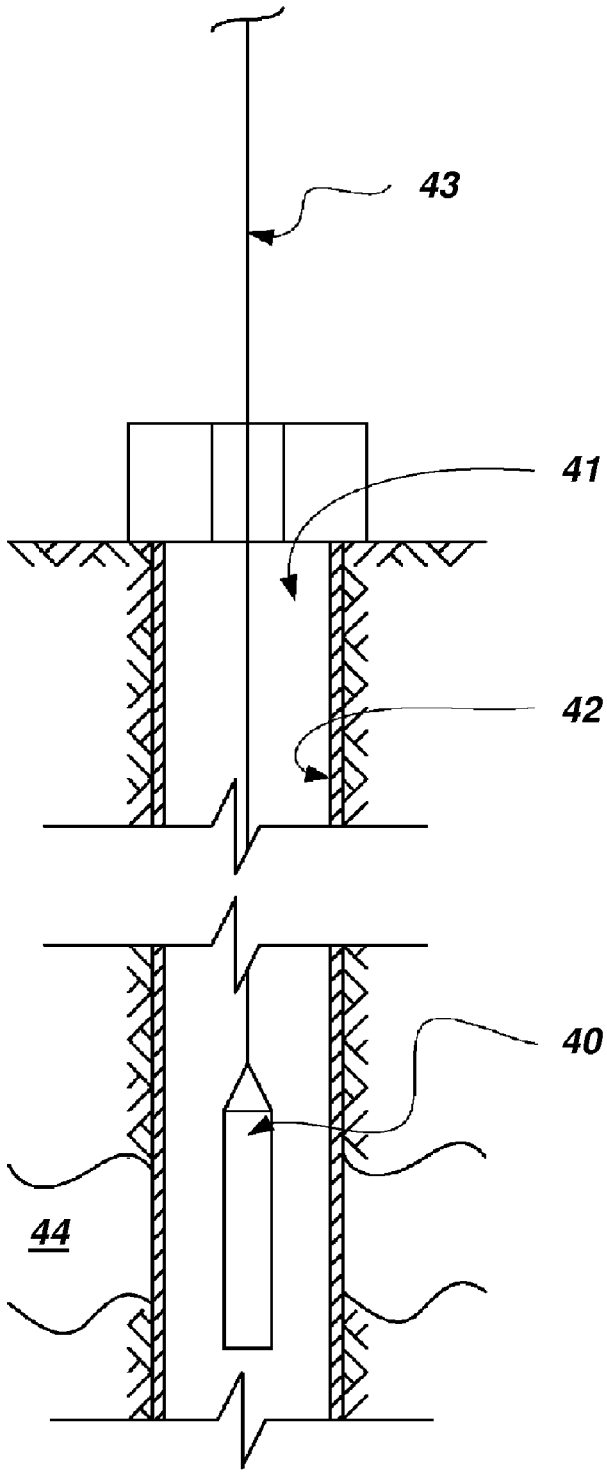
FIG. 4 shows a schematic of a propellant assembly in a subterranean well in accordance with one embodiment of the present invention.

FIG. 4 shows a propellant assembly 40 in accordance with one embodiment of the invention. As shown, a propellant assembly 40 may be deployed in a well 41 having a target well zone 44 to perform fracturing operations. The well 41 may be supported by a casing 42 or other well tubular (e.g., liner, conduit, piping, and so forth) or otherwise an open or uncased well (not shown). The propellant assembly 40 may be deployed in the well 41 via a tool string 43 including, but not limited to, a wireline, a slick line, or coiled tubing. In operation, the propellant assembly 40 may be deployed in the well 41 to perform an operation at the target well zone 44.

Figure 5:
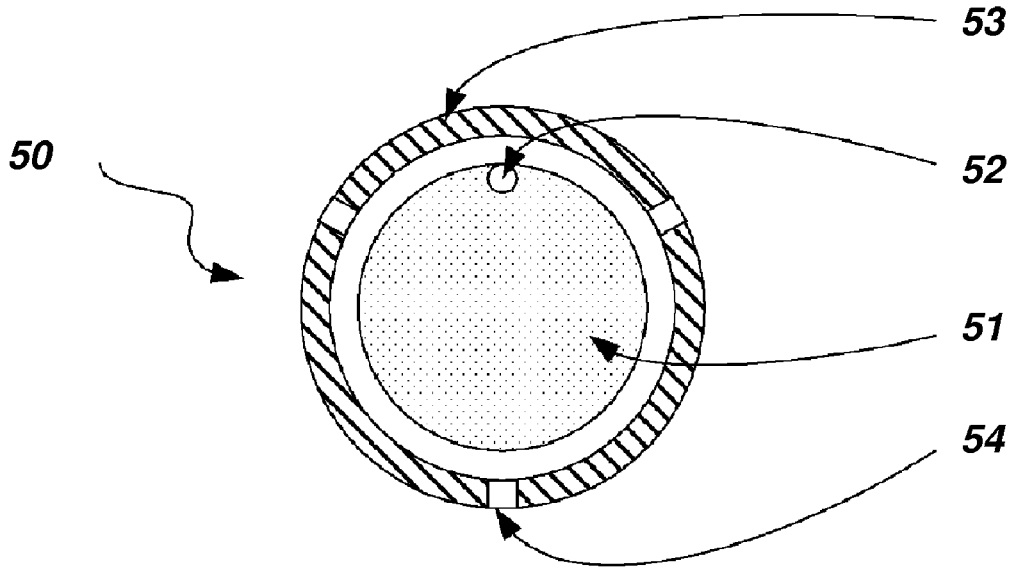
FIG. 5 shows a schematic of a propellant assembly having a ported housing with temporary port seals and a propellant arranged therein in accordance with one embodiment of the present invention.

FIG. 5 shows an embodiment of a propellant assembly 50 having a propellant 51 and detonating cord 52 sealed in a ported housing 53 having one or more temporary port seals 54. The housing 53 may be fabricated from any structurally sturdy material (e.g., metal or plastic) having one or more ports. In some embodiments, the housing may be reusable and in others it may be fabricated for only one use. In the embodiment illustrated in FIG. 5, the propellant 51 burns around the perimeter within the housing 53. The pressure builds until vented to the wellbore through the one or more temporary port seals 54. The temporary port seals 54 illustrated in FIG. 5 are burn-out plugs fabricated from a heat or flame responsive material (e.g., aluminum, magnesium, plastic, plastic composite, ceramic, or a combination of aforementioned material with a coating or bonded layer of energetic material such as plastic-bonded HMX, RDX, HNS, TATB, or others, a thermite compound, or other propellant or pyrotechnic material) that burns away during ignition of the propellant 51 or will otherwise rapidly heat and consume or cause to fail the plug. The temporary port seals 54 may be fabricated to release at particular wellbore pressure. While the embodiments illustrate in FIG. 5 show the detonating cord 52 arranged along the perimeter of the propellant 51 and slightly embedded, in other embodiments the detonating cord may be wrapped around the outer surface of the propellant, embedded completely within the propellant, or otherwise merely run along the outer surface of the propellant. In operation, the propellant 51 is ignited by detonation of the detonating cord 52 and as the propellant burns, gas pressure increases within the axial bore of the housing 53. Once the gas pressure reaches a predetermined level, the temporary port seals 54 actuate to establish communication between the axial bore of the housing 53 and the wellbore. In this way, a higher and more predictable gas vent pressure is achieved to facilitate fracturing the target well zone.

In accordance with embodiments of the present invention, the propellant 51, the detonating cord 52, and the temporary port seals 54 may include one or more high temperature stable explosives of the invention, such as those having chemical structure of formula (I), e.g., BTDAONAB, or formula (II), e.g., MDN. In addition, they may include other high temperature explosives, such as NONA, PATO, BTX, DIPAM, PENCO, TNN, HNAB, TPM, ABH, bis-HNAB, DODECA, HNBP, Z-Tacot, T-Tacot, DPBT, DPPM, HNDS, KHND, ONT, TPB, TPT, PADP-I, NaTNC, HNBIB, TNC, DAT, DADNPO, ONM, ADNBF, DPO, and PIPA. Furthermore, they may include one or more high temperature stable explosives of the invention and one or more other explosive compounds, such as HNS, PYX, HMX, or one or more high temperature stable explosives of the invention combined/mixed with one or more of an energetic material and a fuel. As a result, the propellant, the detonating cord, and the temporary port seals may exhibit exceptional thermal stability characteristics.

It should be noted that the above examples using the high temperature stable explosives of the present invention are intended for illustration purposes only, and are not intended as limitations to the scope of the present invention. From the above discussion, one skilled in the art will recognize that high temperature stable explosives according to embodiments of the invention can be used in a great number of downhole applications. For example, in perforating operations, the high temperature stable explosives may be used not only as the main body of explosives of the shaped charge, but may also be used, for example, for boosters, primers, detonating cords, and detonators. Additionally, the high temperature stable explosives of the present invention may be used to advantage in applications involving tubing and casing cutters, explosive-actuated sleeves, sonic or seismic fracing devices, explosively setting devices, explosively opening production valves, explosive actuated sliding sleeves (valves or shuttles), breakable or frangible elements, tubing release devices, actuating devices, and propellant assemblies.

Embodiments of the invention may include one or more of the following advantages. The high temperature stable explosives may be useful in any number of downhole wells and any number of applications requiring performance capability at high temperatures and/or exposures at elevated temperatures for extended periods of time. Due to the risky nature of the regular explosives and the high temperature downhole conditions, the use of high temperature stable explosives of the present invention in downhole applications is especially beneficial. The use of the above-described method will significantly improve safety and cost effectiveness in downhole applications.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A downhole device having an explosive component, comprising: a high temperature stable explosive having thermal stability greater than 200° C., wherein the explosives having a compound of formula (I):

(I)

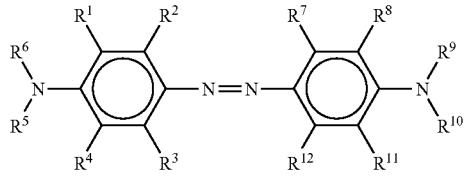

wherein $R^1$, $R^2$, $R^3$, $R^4$, $R^7$, $R^8$, $R^{11}$, and $R^{12}$ are each independently selected from hydrogen and —$NO_2$;

$R^5$, $R^6$, $R^9$, and $R^{10}$ are each independently selected from hydrogen, oxygen, and

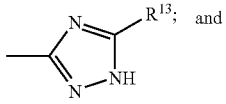

and $R^{13}$ is independently selected from hydrogen and —$NO_2$.

2. The device of claim 1, wherein $R^1$, $R^2$, $R^3$, $R^4$, $R^7$, $R^8$, $R^{11}$, and $R^{12}$ are each —$NO_2$.

3. The device of claim 2, wherein $R^5$, $R^6$, $R^9$, and $R^{10}$ are each independently selected from hydrogen and

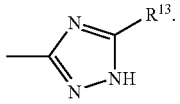

4. The device of claim 3, wherein $R^5$ and $R^9$ are hydrogen, and $R^6$ and $R^{10}$ are

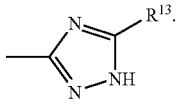

5. The device of claim 4, wherein $R^{13}$ is hydrogen.

6. The device of claim 5, wherein the device is selected from the group consisting of perforating guns, perforating devices, tubing and casing cutters, explosive-actuated sleeves, sonic or seismic fracing devices, explosively setting devices, explosively opening production valves, explosive actuated sliding sleeves, valves or shuttles, breakable or frangible elements, tubing release devices, actuating devices, and propellant assembly.

* * * * *